US005915293A

United States Patent [19]

Welsh et al.

[11] Patent Number: 5,915,293

[45] Date of Patent: Jun. 29, 1999

[54] METHOD FOR COMPENSATING FOR VARIATION IN SHUT HEIGHT DURING STARTING AND STOPPING OF A PRESS

[75] Inventors: Scott D. Welsh, Gibsonia; Daniel G. Lukas, Pittsburgh; Vaughn H. Martin, Gibsonia, all of Pa.

[73] Assignee: Vamco International, Inc., Pittsburgh, Pa.

[21] Appl. No.: 09/006,135

[22] Filed: Jan. 13, 1998

[51] Int. Cl.[6] ..... B30B 15/30; B26D 5/20

[52] U.S. Cl. ..... 100/35; 72/448; 83/13; 83/530; 100/45; 100/257

[58] Field of Search ..... 100/35, 43, 45, 100/53, 215, 216, 257; 72/17.2, 19.8, 20.1, 20.2, 421, 443, 448; 83/373, 403.1, 530, 734, 13

[56] References Cited

U.S. PATENT DOCUMENTS

| | | | |
|---|---|---|---|
| 3,557,686 | 1/1971 | Sapolsky | 100/43 |
| 4,387,632 | 6/1983 | Heiberger | 100/45 |
| 4,480,538 | 11/1984 | Yoshida | 100/43 |
| 5,699,688 | 12/1997 | Allred | 72/421 |

FOREIGN PATENT DOCUMENTS

| | | | |
|---|---|---|---|
| 4-270098 | 9/1992 | Japan | 100/45 |

*Primary Examiner*—Stephen F. Gerrity
*Attorney, Agent, or Firm*—Webb Ziesenheim Logsdon Orkin & Hanson, P.C.

[57] ABSTRACT

A method for compensating for the variation in shut height of a press during stamping and forming as it is starting and stopping comprising user input of the minimum press speed at which feeding of feed material to the press should commence, monitoring of the actual press speed, and feeding of the feed material only when a minimum press speed representing a desired press shut height has been achieved. A method for inputting a desired shut height range, monitoring actual shut height and feeding feed material only when the actual shut height is within the desired shut height range is also disclosed.

30 Claims, 4 Drawing Sheets

METHOD FOR COMPENSATING FOR VARIATION IN SHUT HEIGHT DURING STARTING AND STOPPING OF A PRESS

FIELD OF THE INVENTION

The present invention relates generally to a method for compensating for variation in shut height of a press in a stamping or forming operation when the press or machine is stopped or started.

BACKGROUND OF THE INVENTION

When stamping or forming parts with a press, the formed or coined dimensions of the parts are dependent on the shut height of the press remaining constant. To ensure that the formed or coined dimensions of the parts are acceptable, it is desired that the shut height of the press remain constant or be within a certain tolerance dictated by the nature of the parts. Some precision forming or coining operations, such as those relating to the manufacture of electrical connectors, require that the shut height of the press be held to plus or minus 0.005 mm. If the shut height does not remain constant, part dimensions will vary, possibly outside of allowable tolerances.

Due to thermal and other factors, shut height normally varies slowly as the press runs at constant speed. As the press is stopping and starting, however, the press is operating at a lower speed than the constant speed the press attains during steady state operation and the shut height varies. This shut height variation during starting and stopping is due mainly to dynamic forces.

The typical shut height variation with press speed in strokes per minute (spm) as a high speed press starts up is depicted in FIG. 1. As depicted in FIG. 2, for the operation of a typical press during a particular run, the shut height drops from its initial value at start up at time A to a steady state value within a desired shut height range at time B. From time A to time B, the press speed rises from zero (0) to some relatively constant steady state press speed. During steady state operation from time B to time C, the shut height and press speed remain relatively constant until the press begins to stop at time C. From the initiation of the stopping of the press at time C until the time the press is stopped at time D, the shut height increases while the press speed decrease to zero (0).

The variation in shut height while a press is starting and stopping, as depicted in FIG. 2, means that part dimensions will vary more, possibly out of tolerance values for the parts, as the press is starting and stopping between time A and B and between time C and D.

Shut height variation occurs in presses operating at all speeds. However, shut height variation is much more pronounced, particularly while the press is starting and stopping, for presses operating at higher press speeds (generally above 600 spm).

Technology currently exists for maintaining a constant shut height as a press is running at constant, steady state operational speed. Until the present invention, no technology has existed for compensating for the variation in shut height as a press stops and starts and the press speed is varying. Current technology requires that material be fed to the press while the press is starting and stopping and the press shut height is varying, thereby producing bad, out of tolerance parts due to the varying shut height. The present invention eliminates the production of bad, out of tolerance parts due to varying shut heights as the press is starting and stopping.

SUMMARY OF THE INVENTION

Disclosed is a method for compensating for the variation in shut height of a press as it is starting and stopping comprising user input of the minimum press speed at which feeding of a strip of material out of which the parts are to be coined or stamped, the feed material, should commence, monitoring of the press speed, and feeding of the feed material only when constant, steady state press speed and shut height has been achieved.

A method for compensating for the variation in shut height of a press as it is starting and stopping comprising inputting a desired shut height range at which feeding of the feed material should commenced, monitoring of the actual shut height, and feeding of the feed material only when the shut height is within the desired shut height range is also disclosed.

DETAILED DESCRIPTION OF PREFERRED EMBODIMENTS

Figure 1:
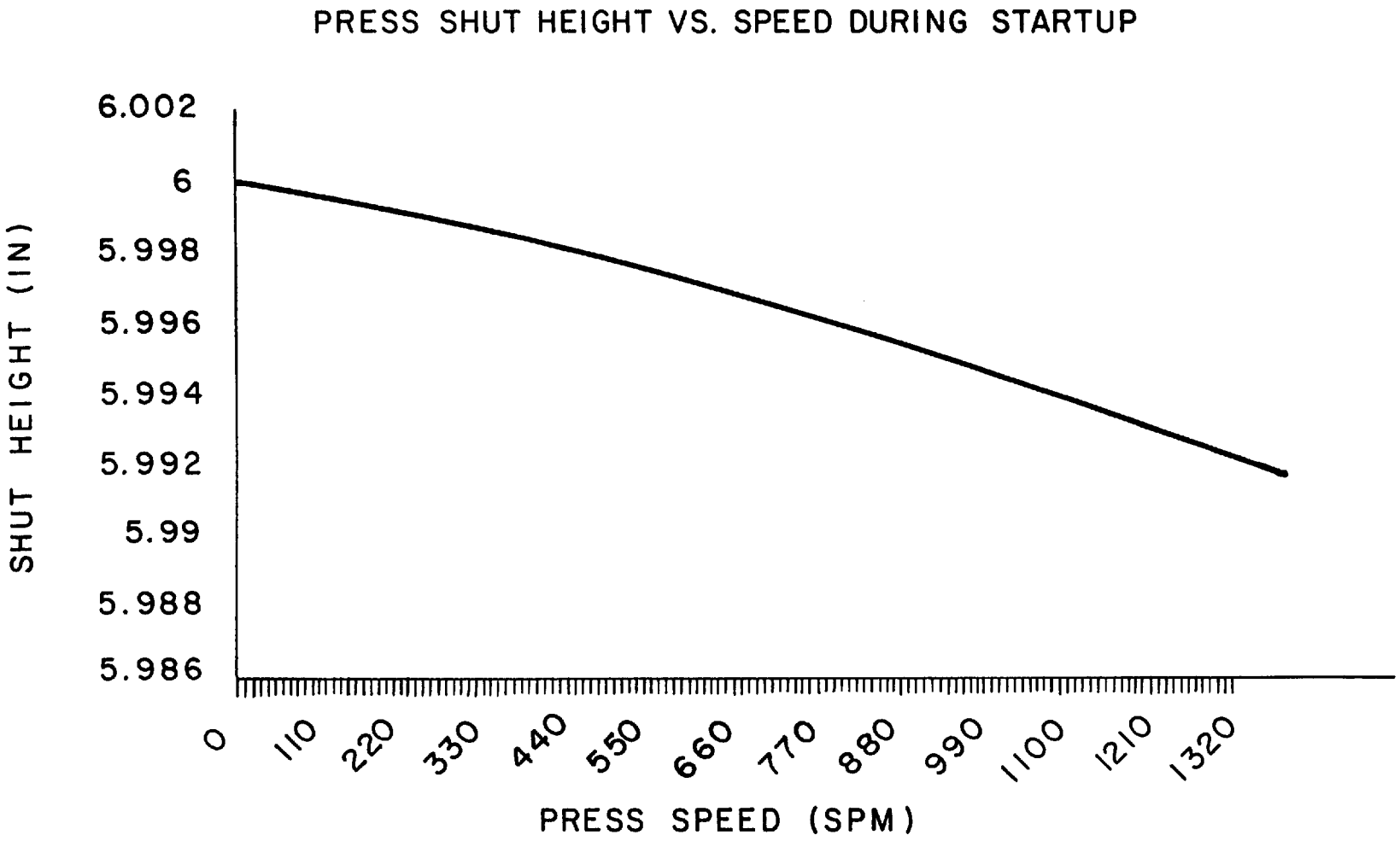
FIG. 1 is a graph of shut height versus press speed during start up of a high speed press.
Figure 2:
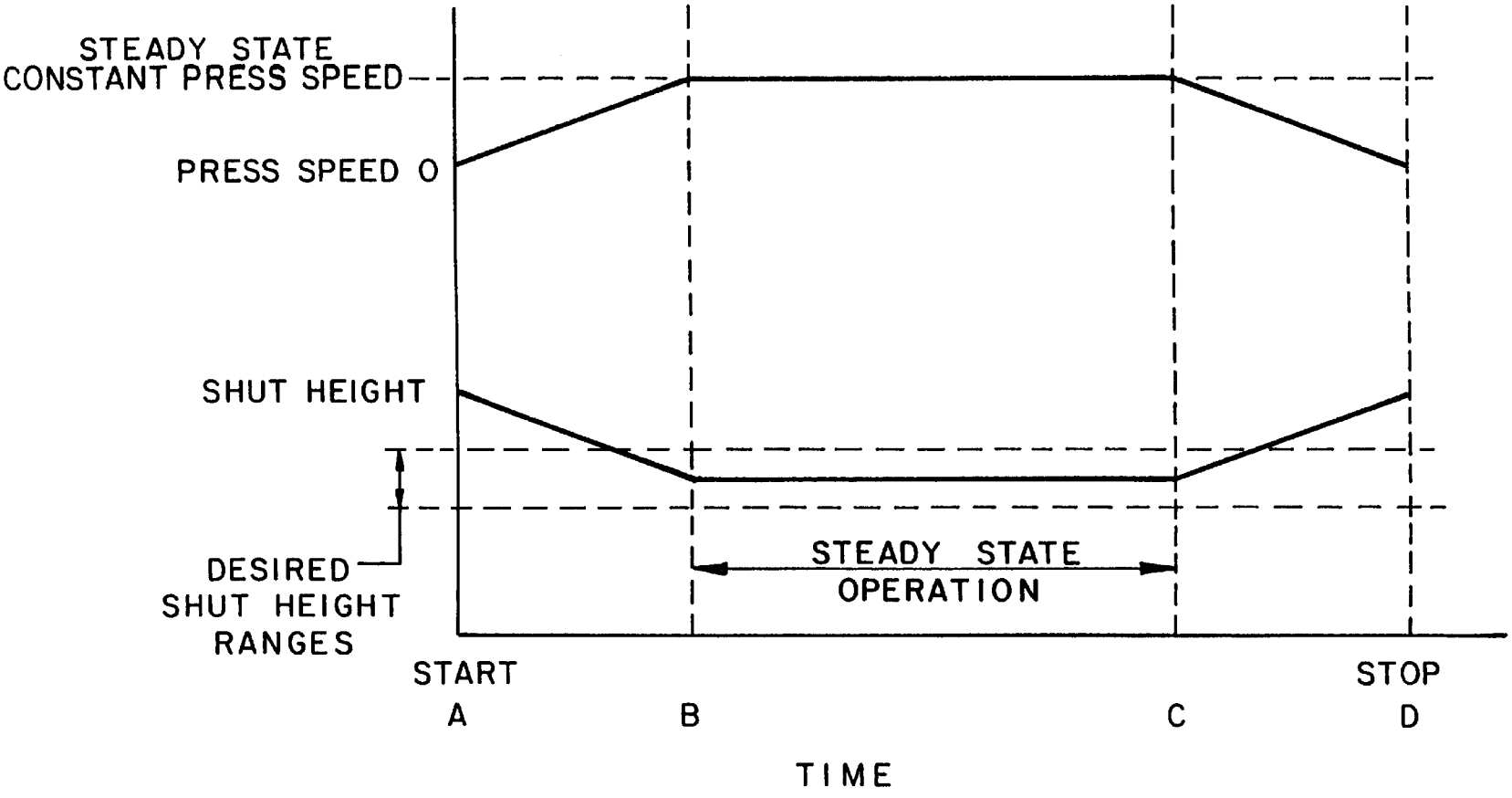
FIG. 2 is a graph of press speed and shut height versus time for a typical press.
Figure 3:
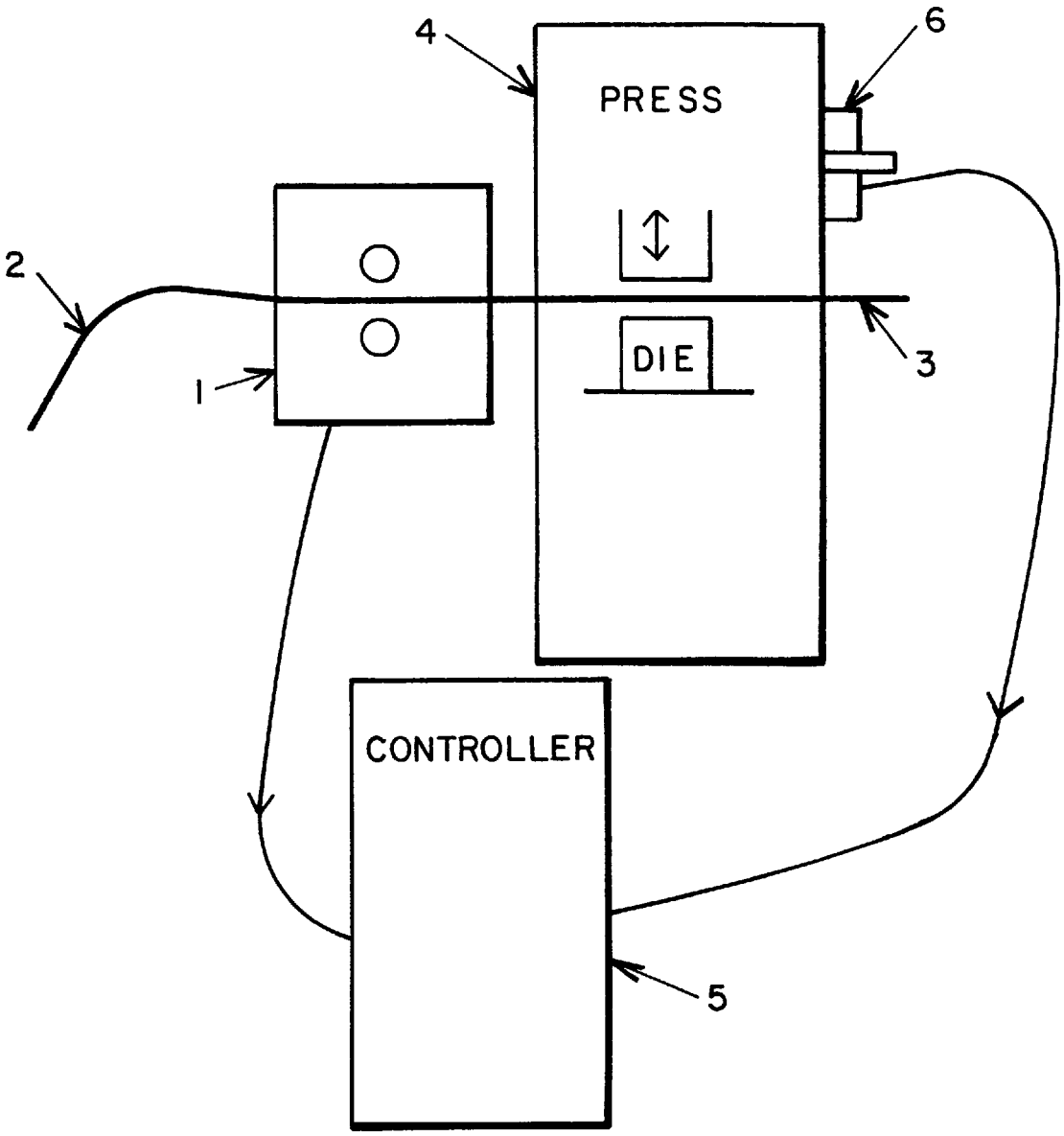
FIG. 3 is a schematic of a preferred embodiment of the invention.

A press feed 1 is typically used to feed strips of the feed material 2 that will be stamped or formed to make the parts 3 to the press 4 as depicted in FIG. 3 in schematic form. In a preferred embodiment, the press feed 1 is an electronically controlled and electronically powered press feed device.

A controller 5 is directly connected to the press feed 1 and the press feedback device 6 which is connected to the press 4. In a preferred embodiment, the controller 5 is capable of controlling the press feed 1, receiving feedback information from the press feedback device 6, and accepting input from the user specifying the minimum press speed at which the press feed 1 should operate. In a preferred embodiment of the method, the controller 5 is capable of accepting direct user input of the minimum press speed. In other preferred embodiments of the method, the controller 5 is capable of accepting an analog or digital signal representing the minimum press speed from a user supplied device (not shown). In another preferred embodiment, the controller 5 is capable of receiving a digital on/off signal from a user supplied auxiliary controller (not shown) which signals when the press shut height has stabilized.

In a preferred embodiment, the press 4 incorporates and is connected to a press feedback device 6 capable of measuring the speed of the press 4 while the press is operating, including when the press 4 is stopping and starting. In a preferred embodiment, the press feedback device is a resolver (not shown). In another preferred embodiment the press feedback device 6 is a velocity feedback device (not shown).

The minimum press speed at which the electronic press feed 1 should begin feeding of the strip of material 2 out of which the parts 3 are to be stamped or formed is input by a user into the controller 5 prior to the commencement of operation of the press 4 and press feed 1. The operation of the press 4 is then started.

The speed at which the press 4 is operating is then measured by the press feedback device 6 of the press 4 which in turn transmits the press speed information back to the controller 5. The controller 5 then compares the speed of the press 4 with the inputted minimum press speed. If the speed of the press 4 is greater than or equal to the inputted minimum press speed, the controller 5 sends a signal to the press feed 1 to start feeding the feed material 2 into the press 4 which will stamp or form the parts 3. If the speed of the press 4 is lower than the inputted minimum press speed, the controller 5 sends a signal to the press feed 1 to remain out of operation or stop feeding the feed material 2.

Once the speed of the press 4 has met or exceeded the minimum press speed, the speed of the press 4 is continually monitored by the press feedback device 6 and compared with the inputted minimum press speed by the controller 5. Should the speed of the press 4 be measured at a value below the inputted minimum press speed at anytime during the operation of the press 4, the controller 5 will send a signal to the press feed 1 to stop feeding the feed material 2. While the press 4 is stopping, the controller 5 will likewise send a signal to the press feed 1 to stop feeding the feed material 2 when the measured press speed sent by the press feedback device 6 back to the controller 5 is below the inputted minimum press speed.

Figure 4:
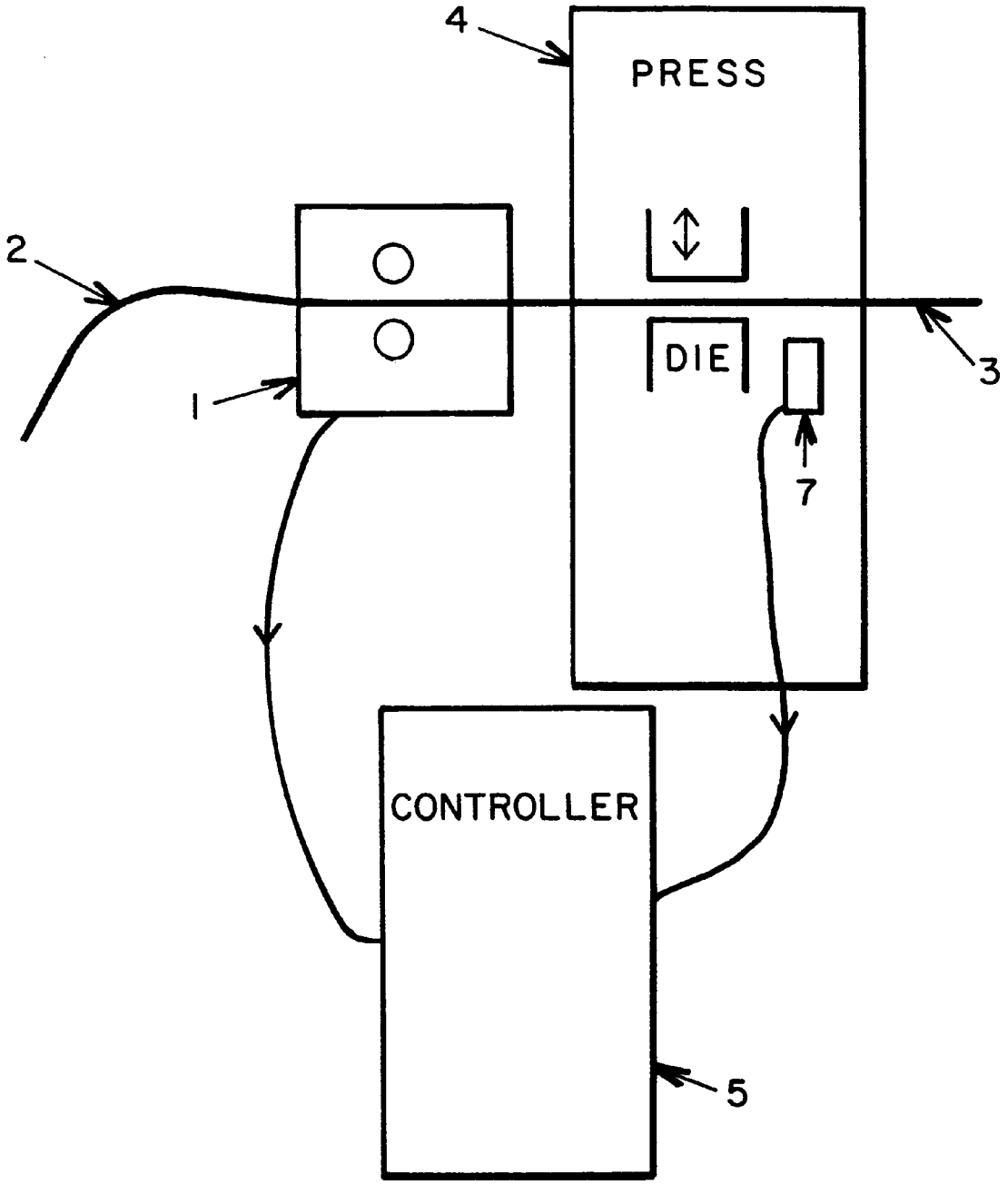
FIG. 4 is a schematic of another preferred embodiment of the invention.

In another preferred embodiment shown in FIG. 4, the press 4 incorporates a press feed back device 7 capable of measuring the shut height of the press 4 while the press 4 is operating, including when the press 4 is stopping and starting. In this preferred embodiment the controller 5 is capable of accepting direct user input of the required shut height range. In another version of this preferred embodiment the controller 5 is capable of accepting an analog or digital signal representing the required shut height range from a user supplied device (not shown).

The required press shut height at which the press feed 1 should begin feeding of the strip of material 2 out of which parts 3 are to be stamped or formed is input into the controller 5 prior to the commencement of operation of the press 4 and press feed 1. The operation of the press 4 is then started after the required press shut height is input.

The shut height at which the press 4 is operating is then measured by the shut height feedback device 7 of the press 4 which in turn transmits the shut height information back to the controller 5. In this preferred embodiment, the feedback device 7 is a linear displacement transducer. The controller 5 then compares the shut height of the press 4 with the inputted desired shut height range. If the measured shut height is within the desired range specified, the controller 5 sends a signal to the press feed 1 to feed material 2. The controller 5 continually monitors the press shut height via the feedback device 7. If at anytime during operation of the press 4, the shut height deviates outside the specified range, controller 5 signals the press feed 1 to stop feeding material 2.

In a third preferred embodiment, when it is sufficient to prevent the production of bad parts at press start up and not at press stoppage, the feedback device 7 may be replaced with a stroke-counter (not shown). The user inputs a value representing the number of press strokes to skip during start up to the controller 5. The controller 5 then compares the number of press strokes counted by the stroke-counter and transmitted to the controller 5 to the inputted number of press strokes to skip. When the number of press strokes counted by the stroke-counter exceeds the inputted number of press strokes to skip, the controller 5 signals the press feed 1 to begin feeding the feed material 2.

In a preferred embodiment of the embodiments described above, the press 4 is a high speed punch press, with tooling. Other embodiments may involve other forms of presses with various operational speeds because shut height variation occurs for presses operating at any speed. In a preferred embodiment of the embodiments described above, the press 4 is a electronically controlled and electronically powered press feed.

The embodiments described above are to be considered in all respects only as illustrative and not restrictive. The scope of the invention is indicated by the following claims rather than the foregoing description. All changes which come within the meaning and range of equivalency of the claims are to be embraced within their scope.

What is claimed is:

1. A method for compensating for the variation in shut height of a press as it is starting and stopping comprising:

input of the minimum press speed of said press at which feeding of the feed material should commence;

continuous monitoring of the actual press speed of said press; and feeding of said feed material by a press feed only when said actual press speed is at least equal to said minimum press speed.

2. The method of claim 1 wherein said feeding of said feed material by said press feed is stopped when said actual press feed is less than said minimum press speed.

3. The method of claim 1 wherein said press is a high speed punch press.

4. The method of claim 1 wherein the continuous monitoring of said actual press speed is performed by a resolver.

5. The method of claim 1 wherein the press feed is an electronically controlled and electronically powered press feed.

6. The method of claim 1 wherein said minimum press speed is a press speed at which said shut height of said press is within a desired tolerance value.

7. The method of claim 1 wherein said minimum press speed is input by direct user input into a controller for said press.

8. The method of claim 1 wherein said minimum press speed is input into a controller for said press by digital signal from a user supplied auxiliary controller.

9. A method for compensating for the variation in shut height of a press as it is starting and stopping comprising:

input of the minimum press speed of said press at which feeding of the feed material should commence to a controller;

continuous monitoring of the actual press speed of said press;

feedback of said actual press speed of said press to said controller by a feedback device;

comparison of said actual press speed of said press with said minimum press speed of said press by said controller;

sending a signal from said controller to a press feed to begin feeding said feed material to said press when said actual press speed of said press is at least equal to said minimum press speed; and sending a signal from said controller to said press feed to stop feeding said feed material to said press when said actual press speed of said press is less than said minimum press speed.

10. The method of claim 9 wherein said press is a high speed punch press.

11. The method of claim 9 wherein said feedback device is a resolver.

12. The method of claim 9 wherein the press feed is an electronically controlled and electronically powered press feed.

13. The method of claim 9 wherein said minimum press speed is a press speed at which said shut height of said press is within a desired tolerance value.

14. The method of claim 9 wherein said minimum press speed is input by direct user input into said controller.

15. The method of claim 9 wherein said minimum press speed is input into said controller by digital signal from a user supplied auxiliary controller.

16. A method for compensating for the variation in shut height of a press as it is starting and stopping comprising:

input of the desired shut height range of said press at which feeding of the feed material should commence;

continuous monitoring of the actual shut height of said press; and feeding of said feed material by a press feed only when said actual shut height is within the desired shut height range.

17. The method of claim 16 wherein said press is a high speed punch press.

18. The method of claim 16 wherein the continuous monitoring of said actual shut height is performed by a linear displacement transducer.

19. The method of claim 16 wherein the press feed is an electronically controlled and electronically powered press feed.

20. The method of claim 16 wherein said desired shut height range is a shut height of said press that enables parts to be produced within a desired tolerance value.

21. The method of claim 16 wherein said desired shut height range is input by direct user input into a controller for said press.

22. The method of claim 16 wherein said desired shut height range is input into a controller for said press by digital signal from a user supplied auxiliary controller.

23. A method for compensating for the variation in shut height of a press as it is starting and stopping comprising:

input to a controller of the desired shut height range of said press at which feeding of the feed material should commence;

continuous monitoring of the actual shut height of said press;

feedback of said actual shut height of said press to said controller by a feedback device;

comparison of said actual shut height of said press with said desired shut height range of said press by said controller;

sending a signal from said controller to a press feed to begin feeding said feed material to said press when said actual shut height of said press is at least within said desired shut height range; and sending a signal from said controller to said press feed to stop feeding said feed material to said press when said actual shut height of said press is outside of said desired press shut height range.

24. The method of claim 23 wherein said press is a high speed punch press.

25. The method of claim 23 wherein said feedback device is a linear displacement transducer.

26. The method of claim 23 wherein the press feed is an electronically controlled and electronically powered press feed.

27. The method of claim 23 wherein said desired shut height range is a shut height of said press that ensures that the parts produced by said press are within a desired tolerance value.

28. The method of claim 23 wherein said desired shut height range is input by direct user input into said controller.

29. The method of claim 23 wherein said desired shut height range is input into said controller by digital signal.

30. The method of claim 23 wherein said desired shut height range is input into said controller by analog signal.

* * * * *